US010920562B2

(12) United States Patent
Janakiraman et al.

(10) Patent No.: US 10,920,562 B2
(45) Date of Patent: Feb. 16, 2021

(54) REMOTE CONTROL AND MONITORING OF ENGINE CONTROL SYSTEM

(71) Applicant: Schlumberger Technology Corporation, Sugar Land, TX (US)

(72) Inventors: Shyam Janakiraman, Houston, TX (US); Seetharam Kothuru, Houston, TX (US); Ramakrishna Madhireddy, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/177,492

(22) Filed: Nov. 1, 2018

(65) Prior Publication Data

US 2019/0128107 A1 May 2, 2019

Related U.S. Application Data

(60) Provisional application No. 62/580,110, filed on Nov. 1, 2017.

(51) Int. Cl.

| | |
|---|---|
| ***E21B 44/00*** | (2006.01) |
| ***E21B 41/00*** | (2006.01) |
| ***E21B 47/12*** | (2012.01) |

(52) U.S. Cl.

CPC ..... *E21B 44/00* (2013.01); *E21B 41/0085* (2013.01); *E21B 47/12* (2013.01)

(58) Field of Classification Search

None

See application file for complete search history.

(56) References Cited

U.S. PATENT DOCUMENTS

| | | | |
|---|---|---|---|
| 4,482,857 | A | 11/1984 | Porche et al. |
| 5,950,953 | A | 9/1999 | Baugh et al. |
| 6,639,331 | B2 | 10/2003 | Schultz |
| 6,812,811 | B2 | 11/2004 | Robison et al. |
| 6,873,267 | B1 | 3/2005 | Tubel et al. |
| 6,913,097 | B1 | 7/2005 | Orr et al. |
| 6,920,085 | B2 | 7/2005 | Finke et al. |
| 7,038,332 | B2 | 5/2006 | Robison et al. |
| 7,137,586 | B2 | 11/2006 | Talen |
| 7,145,472 | B2 | 12/2006 | Lilly et al. |
| 7,210,647 | B2 | 5/2007 | Dion |
| 7,318,488 | B2 | 1/2008 | Hutchinson |
| 7,447,051 | B2 | 11/2008 | Masino et al. |
| 7,574,325 | B2 | 8/2009 | Dykstra |

(Continued)

FOREIGN PATENT DOCUMENTS

| | | | |
|---|---|---|---|
| CN | 106786786 | A | 5/2017 |
| WO | 2015190934 | A1 | 12/2015 |

(Continued)

*Primary Examiner* — Giovanna Wright
*Assistant Examiner* — Dany E Akakpo
(74) *Attorney, Agent, or Firm* — Jeffrey D. Frantz

(57) ABSTRACT

Systems and methods for controlling a drilling rig are disclosed herein. A driller can select between modes: local, human-machine interface (HMI), and automatic. In a local mode a motor operator is instructed to operate a genset for the drilling rig. In a Remote mode the driller can operate the genset directly without the need for a motor operator to start or stop the gensets. In an automatic mode, the genset is controlled according to a well plan including a power consumption schedule.

22 Claims, 2 Drawing Sheets

(56) References Cited

U.S. PATENT DOCUMENTS 7,717,193 B2 5/2010 Egilsson et al.
7,762,131 B2 7/2010 Ibrahim et al.
7,819,209 B1 10/2010 Bezner
7,854,636 B2 12/2010 Gilliam
7,869,444 B2 1/2011 Menard et al.
7,878,250 B2 2/2011 Sheldon
7,970,830 B2 6/2011 Staggs et al.
8,061,644 B1 11/2011 Dion
8,154,419 B2 4/2012 Daussin et al.
8,164,980 B2 4/2012 Sullivan et al.
8,204,692 B2 6/2012 Arango et al.
8,219,258 B1 7/2012 Almeida et al.
8,250,816 B2 8/2012 Donnally et al.
8,260,736 B1 9/2012 Lear et al.
8,285,277 B2 10/2012 Parker
8,301,386 B1 10/2012 Redmond et al.
8,358,220 B2 1/2013 Savage
8,423,397 B2 4/2013 Sitton
8,446,037 B2 5/2013 Williams
8,519,565 B2 8/2013 Dozier et al.
8,604,639 B2 12/2013 Hopwood
8,615,082 B1 12/2013 Selman et al.
8,616,274 B2 12/2013 Belcher et al.
8,639,021 B2 1/2014 Kim et al.
8,706,899 B2 4/2014 Sunanda
8,761,912 B1 6/2014 Chapman, Jr. et al.
8,798,802 B2 8/2014 Almeida et al.
8,838,695 B2 9/2014 Foreman et al.
8,935,100 B2 1/2015 Weiner et al.
9,013,322 B2 4/2015 Roberson et al.
9,024,778 B2 5/2015 Winkler et al.
9,026,270 B2 5/2015 Poettker et al.
9,035,789 B2 5/2015 Loi et al.
9,043,235 B1 5/2015 Sacks et al.
9,059,587 B2 6/2015 Williams
9,065,300 B2 6/2015 Williams
9,074,468 B1 7/2015 Selman et al.
9,107,137 B1 8/2015 Zawodniok et al.
9,175,557 B2 11/2015 Iversen et al.
9,194,228 B2 11/2015 Hall
9,197,071 B2 11/2015 Williams
9,206,658 B1 12/2015 Dion
9,212,499 B1 12/2015 Maurer
9,219,760 B2 12/2015 Flanders et al.
9,240,687 B2 1/2016 Carralero et al.
9,255,473 B2 2/2016 Burress et al.
9,268,773 B2 2/2016 Arango et al.
9,322,247 B2 4/2016 Rojas et al.
9,359,882 B2 6/2016 Snyder
9,360,852 B2 6/2016 Masten et al.
9,380,261 B2 6/2016 Sherburne
9,391,839 B2 7/2016 Phillips
9,408,039 B2 8/2016 Ralston et al.
9,429,009 B2 8/2016 Paulk et al.
9,429,678 B2 8/2016 Abitrabi et al.
9,441,428 B1 9/2016 Barnes et al.
9,441,430 B2 9/2016 Selman et al.
9,450,433 B2 9/2016 Di Cristofaro
9,466,197 B2 10/2016 Hildick-Pytte
9,518,459 B1 12/2016 Bermudez Martinez et al.
9,528,697 B2 12/2016 Sonnervig et al.
9,531,204 B2 12/2016 Di Cristofaro
9,535,410 B2 1/2017 Di Cristofaro
9,537,315 B2 1/2017 Kuttel et al.
9,543,748 B2 1/2017 Andersen et al.
9,546,545 B2 1/2017 Cardellini et al.
9,644,431 B2 5/2017 Myers et al.
9,670,767 B2 6/2017 Hernandez et al.
9,706,185 B2 7/2017 Ellis
9,726,003 B2 8/2017 Pettapiece et al.
9,732,604 B2 8/2017 Haines et al.
9,734,525 B2 8/2017 Lunenfeld
9,739,141 B2 8/2017 Zeng et al.
9,749,598 B2 8/2017 Richardson et al.
9,749,717 B2 8/2017 White et al.
9,759,025 B2 9/2017 Vavik
9,766,364 B2 9/2017 Hickman
9,777,570 B2 10/2017 Braisher et al.
9,784,097 B2 10/2017 Dugas
9,797,234 B1 10/2017 Forstner et al.
9,803,461 B2 10/2017 Boone
9,806,530 B2 10/2017 Martinez
9,810,055 B2 11/2017 Hall
9,819,292 B2 11/2017 Thatcher et al.
9,845,664 B2 12/2017 Nield
9,850,712 B2 12/2017 Sugiura
9,910,180 B2 3/2018 Donderici et al.
9,915,128 B2 3/2018 Hunter
9,938,780 B2 4/2018 Begnaud
10,017,993 B2 7/2018 Hu et al.
10,027,128 B2 7/2018 Muller
10,151,178 B2 12/2018 Stephenson et al.
2003/0205410 A1* 11/2003 Koch ..... E21B 7/046 175/45
2008/0203734 A1 8/2008 Grimes et al.
2009/0195074 A1 8/2009 Buiel
2009/0312885 A1 12/2009 Buiel
2010/0156117 A1* 6/2010 Allen ..... H02J 9/08 290/40 C
2013/0106615 A1 5/2013 Prammer
2013/0234515 A1* 9/2013 Boone ..... E21B 44/00 307/43
2014/0326449 A1 11/2014 Samuel et al.
2014/0350744 A1 11/2014 Almeida, Jr. et al.
2015/0372492 A1 12/2015 Kuttel et al.
2016/0036367 A1 2/2016 McCall et al.
2016/0084076 A1 3/2016 Fanini et al.
2016/0145947 A1 5/2016 Myers et al.
2016/0186531 A1 6/2016 Harkless et al.
2016/0190963 A1 6/2016 Thatcher et al.
2017/0067303 A1 3/2017 Thiemann et al.
2017/0077705 A1 3/2017 Kuttel et al.
2017/0175447 A1 6/2017 Gharib et al.
2017/0184754 A1 6/2017 Rozenblit et al.
2017/0204690 A1 7/2017 Hess et al.
2017/0211338 A1 7/2017 Myers et al.
2017/0218745 A1 8/2017 Erdos et al.
2017/0229869 A1 8/2017 Boone et al.
2017/0241252 A1 8/2017 Hernandez et al.
2017/0270768 A1 9/2017 Valleru
2017/0298722 A1 10/2017 Pettapiece et al.
2017/0314369 A1 11/2017 Rosano et al.
2017/0321503 A1 11/2017 Lane
2017/0328193 A1 11/2017 Holt et al.
2017/0328196 A1 11/2017 Shi et al.
2017/0328197 A1 11/2017 Shi et al.
2017/0335683 A1 11/2017 Pool
2017/0342808 A1 11/2017 Dykstra et al.
2017/0370190 A1 12/2017 Bagnaro
2017/0370204 A1 12/2017 Dahl
2018/0012384 A1 1/2018 Marland et al.
2018/0023354 A1 1/2018 Dion
2018/0023381 A1 1/2018 Xue et al.
2018/0035566 A1 2/2018 Held et al.
2018/0058193 A1 3/2018 Hall
2018/0066506 A1 3/2018 Boone
2018/0066513 A1 3/2018 Sugiura et al.
2018/0080286 A1 3/2018 Begnaud
2018/0080310 A1 3/2018 Sorenson et al.
2018/0123384 A1 5/2018 Foo et al.
2018/0175626 A1 6/2018 Gerdes et al.
2019/0048666 A1 2/2019 Orban et al.
2019/0048667 A1 2/2019 Krippner et al.
2019/0071828 A1 3/2019 Orban
2019/0115758 A1 4/2019 Orban et al.

FOREIGN PATENT DOCUMENTS

WO 2016102381 A1 6/2016
WO 2017011585 A1 1/2017
WO 2017139631 A1 8/2017
WO 2017192814 A2 11/2017
WO 2017217905 A1 12/2017

(56) References Cited

FOREIGN PATENT DOCUMENTS

| | | | |
|---|---|---|---|
| WO | 2018201118 | A1 | 11/2018 |
| WO | 2018204293 | A1 | 11/2018 |
| WO | 2018213925 | A1 | 11/2018 |

* cited by examiner

REMOTE CONTROL AND MONITORING OF ENGINE CONTROL SYSTEM

CROSS REFERENCE TO RELATED APPLICATIONS

This application claims priority to U.S. Provisional Patent Application No. 62/580,110 entitled REMOTE CONTROL AND MONITORING OF ENGINE CONTROL SYSTEM filed on Nov. 1, 2017 which is incorporated herein by reference in its entirety.

BACKGROUND

Drilling rigs are typically operated by a driller and a motor operator. The motor operator operates the engines/generator (sometimes referred to as gensets) including starting, idling, and running one or more gensets that provide the power to the drilling rig. A genset is an engine-generator or portable generator is the combination of an electrical generator and an engine (prime mover) mounted together to form a single piece of equipment. This combination is also called an engine-generator set or a gen-set. In many contexts, the engine is taken for granted and the combined unit is simply called a generator. In addition to the engine and generator, engine-generators generally include a fuel supply, a constant engine speed regulator (governor) and a generator voltage regulator, cooling and exhaust systems, and lubrication system. Units larger than about 1 kW rating often have a battery and electric starter motor. Very large units may start with compressed air either to an air driven starter motor or introduced directly to the engine cylinders to initiate engine rotation. Standby power generating units often include an automatic starting system and a transfer switch to disconnect the load from the utility power source when there is a power failure and connect it to the generator. In the oilfield, a driller instructs the motor operator when to start, stop, idle, etc. the various gensets. Much of the success of the drilling operation depends on how these two individuals operate together to operate the drill rig. There are several inefficiencies that arise from this relationship.

SUMMARY

Various features of the present disclosure are described herein. Embodiments of the present disclosure are directed to a system for operating a genset for a drilling rig. The system can include a remote (HMI) component and a genset configured to run to provide power to a drilling rig. The remote component is configured to receive instructions to operate the genset and to deliver the instructions to the genset to operate the genset without the intervention of a motor operator.

In other embodiments the system also includes an idle control component configured to operate the genset in automatic idle mode in which the genset will shut off after a predetermined criteria is met and a constant idle mode in which the genset will continue to idle until instructed to stop and wherein the remote (HMI) component is configured to permit selection between the automatic idle mode and constant idle mode.

Further embodiments of the present disclosure are directed to a method of operating a drilling rig including a genset, including operating a genset to provide power to a drilling operation, and receiving a selection between local mode, remote (HMI) mode, and automatic mode. Local mode requires a motor operator to manually start and stop the genset. Remote mode enables a driller to operate the genset via a HMI without needing a motor operator. In an automatic mode the genset is operated according to predetermined instructions.

Further embodiments of the present disclosure are directed to a system for operating a power system for a drilling operation. The system includes a first terminal at the power system and configured to be operated by a motor operator, and a second terminal at a remote location and configured to be operated by a driller. The system can also include a human-machine-interface (HMI) configured to facilitate communication between the first terminal, the second terminal, and the power system. The HMI permits the motor operator and the driller to communicate about operation of the power system, and permits the driller at the second terminal to operate the power system with requiring action from the motor operator at the first terminal.

In further embodiments the power system is configured to operate in an automatic idle mode in which the power system will shut off under predefined conditions and a constant idle mode in which the power system will continue to idle until instructed to stop from either the first or second terminal. In still further embodiments the second terminal is configured to receive inputs to select between automatic idle mode and constant idle mode.

DETAILED DESCRIPTION

Figure 1:
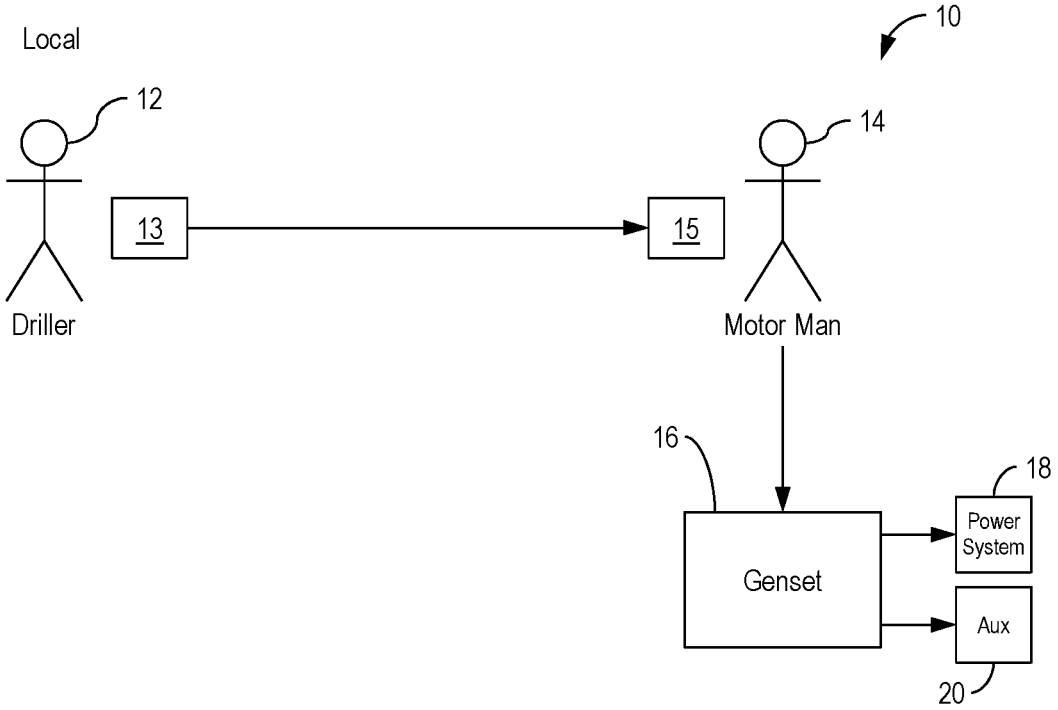
FIG. 1 is an illustration of a drilling system in a local configuration including a driller, a motor operator, and a genset according to embodiments of the present disclosure.

Below is a detailed description according to various embodiments of the present disclosure. FIG. 1 is an illustration of a drilling system 10 in a local configuration including a driller 12, a driller terminal 13, a motor operator 14 (a.k.a. Motor Man), a motor operator terminal 15, and a genset 16. The genset 16 is coupled to a power system 18 and several accessories 20. The power system 18 includes rectifiers, VFD's, drilling motors, tools and a drill bit and components of a drill string coupled to the drill bit that is used to bore a well into the earth. The accessories 20 can be any auxiliary equipment required by the rig, including anything from lights on the rig to electrical systems and HVAC on the rig. The genset 16 can represent one in an array of gensets used by a given rig. Some rigs have multiple gensets, each of which can be operated as shown herein. For purposes of brevity in FIG. 1 a single genset is shown but it is to be appreciated by a person of ordinary skill that the genset 16 can represent multiple gensets, or that individual gensets in an array can individually be controlled and operated according to the systems and methods of the present disclosure.

To operate the genset 16, the driller 12 issues instructions to the motor operator 14 who then executes the instructions. For example, if the driller 12 instructs the motor operator 14 to start the genset 16, the motor operator 14 starts the genset 16 using a key or a button or whatever starting mechanism there is for the genset 16. The driller's instructions are based on the judgement of the driller and depend on the skill and information available to the driller to operate the rig to perform the necessary operations of the rig. This configuration is referred to herein as the "local" configuration.

Figure 2:
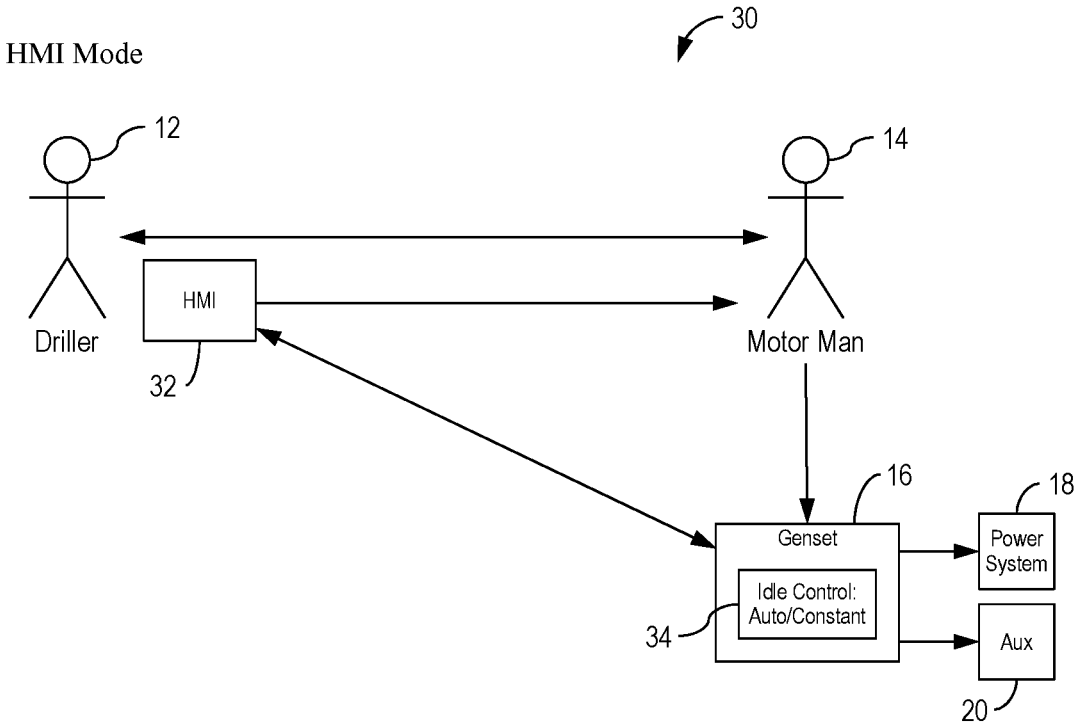
FIG. 2 is an illustration of a drilling system in a Remote (Human-Machine Interface—HMI) configuration including a driller, a motor operator and a genset according to embodiments of the present disclosure.

FIG. 2 is an illustration of a drilling system 30 in a Remote (Human-Machine Interface "HMI") configuration including a driller 12, a motor operator 14 and a genset 16 according to embodiments of the present disclosure. In the Remote configuration, the driller 12, motor operator 14, genset 16, the power system 18, and accessories 20 can operate the same way they do in a local configuration if the driller so desires. The Remote configuration, however, further includes an HMI 32 that can comprise a monitor and I/O capabilities such as a keyboard and mouse or touch screen or any equivalent I/O methods. The HMI 32 can also include a computer or other equivalent computational equipment. The HMI 32 can interface with the motor operator 14 and with the genset 16 directly, under the direction of the driller 12. For example, if the driller wants to start the genset 16, he can select via the HMI 32 a command to be issued to the genset 16 which can then execute the command to start. The motor man 14 can confirm back to the driller 12 that all is ready to proceed. With this confirmation and using the HMI 32, the driller 12 therefore can bypass the Motor Man 14 and directly control the genset 16. The driller 12 also has the option of communicating with the Motor Man 14 directly if the need should arise. The confirmation from the Motor Man 14 can be required, encouraged, or suggested. In some embodiments the driller can proceed without the confirmation from the Motor Man 14.

The HMI 32 also directs communication from the genset 16 back to the driller 12. From time to time there are issues that arise in the genset 16 or perhaps simply readings of interest. The genset 16 is configured to report these readings back to the driller 12 through the HMI 32. The driller 12 is therefore better informed of the status of the genset 16 without relying solely on the alertness or capabilities of the Motor Man 14.

In further embodiments of the present disclosure the genset 16 can include an idle control component 34 that can include two or more idling settings. An auto idling setting allows the genset to turn on and to idle in preparation for use by the power system 18 or accessories 20. If the need for the genset 16 is not realized within a given predefined time period, the genset 16 will turn off. The time period for shut off can be controlled via the HMI 32. Idling the genset 16 before use will allow the genset 16 to warm up to achieve greater efficiency during use.

In a constant idle mode, the genset 16 is instructed to idle indefinitely with no timer for shut down. The idle control component 34 can be configured to start or stop the genset 16 in response to any criteria given to it by the driller 12 through the HMI 32. For example, on a hot day the genset 16 will need less time (perhaps zero time) to warm up in which case the idle control component 34 will not instruct the genset 16 to idle; rather, the genset 16 will turn on when the power is required. In another example, in a cold environment there may be a need to maintain the genset 16 above a given temperature which may require idling even without an instruction from the driller 12 and without an imminent need for power.

Figure 3:
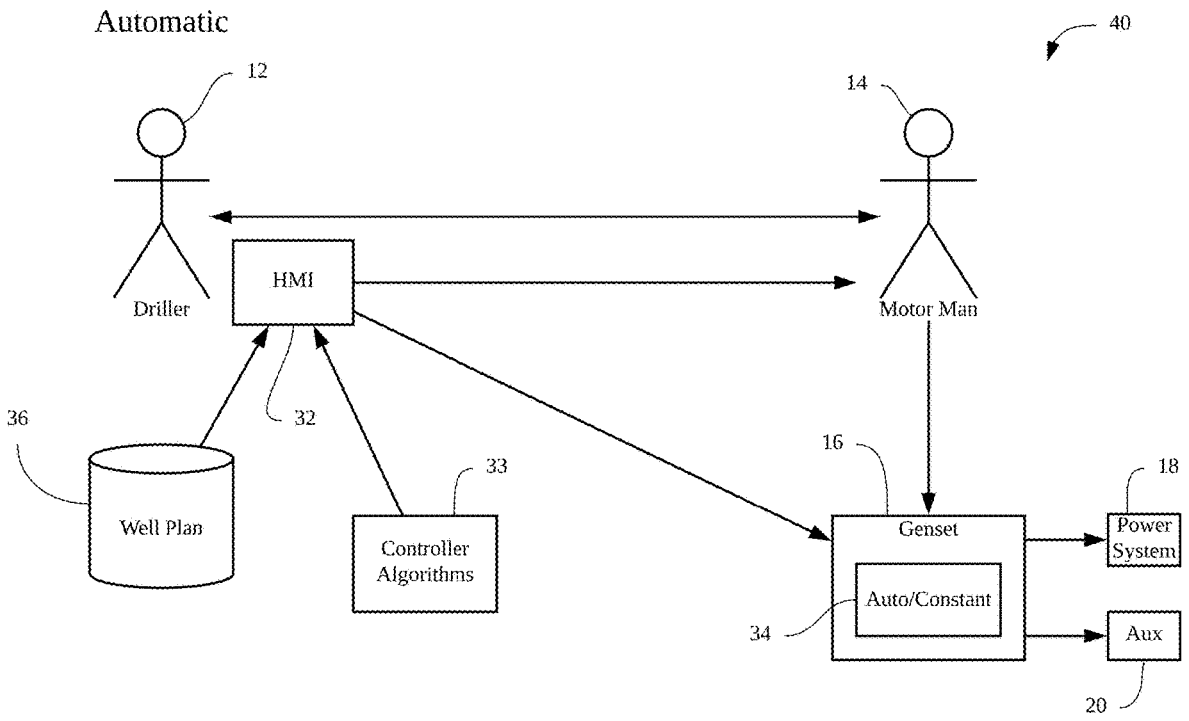
FIG. 3 is an illustration of a drilling system in an automatic configuration according to embodiments of the present disclosure.

FIG. 3 is an illustration of a drilling system 40 in an automatic configuration according to embodiments of the present disclosure. The system 40 includes a well plan 36 which can be stored on a database or another suitable computer-readable memory component. The well plan 36 can also be referred to as a Rig State or Predictive Control module and it includes information detailing how and when to operate the genset 16. The well plan 36 can be compiled in advance of the drilling operation and can include data regarding the formation in which the drilling is to be carried out and other characteristics of the drilling operation. For example, the well plan 36 can have a schedule of power needs and can instruct the genset 16 to start, idle, stop, etc. according to the schedule. The instructions of the well plan 36 can be communicated to the genset 16 through the HMI 32. The driller 12 also has control over the system and if necessary can alter or stop procedures called for by the well plan 36. The operator 14 can also intervene if he observes a problem or a situation in need of attention.

The HMI 32 can also receive instructions from controller algorithms 33 that can come from operations taking place in a controller at the local machine or at any other related point in the operation. In some embodiments there is no well plan data that drives the need for the genset 16 to be active, but with access to the controller in the form of controller algorithms 33, the genset 16 can be turned on or off as needed. The driller 12 can be given the option to ovverride these inputs through the use of the HMI 32.

Figure 4:
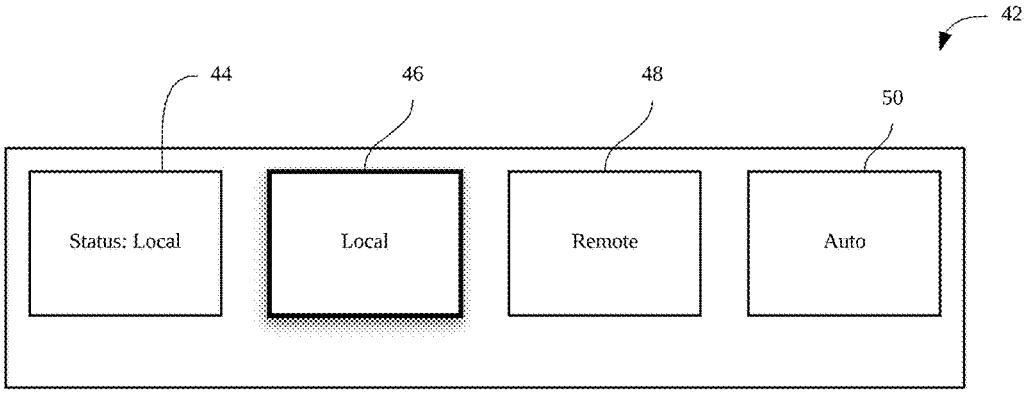
FIG. 4 is a schematic graphic user interface (GUI) for the HMI according to embodiments of the present disclosure.

FIG. 4 is a schematic graphic user interface (GUI) 42 for the HMI 32 according to embodiments of the present disclosure. The GUI 42 can present a selection to the driller 12 between local, remote, and automatic configurations. In FIG. 4, the driller has selected "local" and the GUI 42 represents this choice in a first window 44. The first window 44 can say "remote" or "auto" if the user makes the selection. The selected choice (local/remote/auto) will be active at any given time. The GUI 42 can include selectable buttons 46, 48, and 50 for local, remote and automatic modes, respectively. The GUI 42 can be a controlled via a touch screen, keyboard and mouse, or any other suitable I/O mechanism. A communication link is established between the genset and the engine controller to gather all the information that is required for the algorithms to make the decisions in the Remote and Auto configurations.

The foregoing disclosure hereby enables a person of ordinary skill in the art to make and use the disclosed systems without undue experimentation. Certain examples are given to for purposes of explanation and are not given in a limiting manner.

The invention claimed is:

1. A system for operating a genset for a drilling rig, the system comprising:

a remote (HMI) component;

a genset configured to run to provide power to the drilling rig; and an idle control component configured to operate the genset in:

an automatic idle mode in which the genset shuts off after a predetermined criteria is met; and a constant idle mode in which the genset continues to idle until instructed to stop;

wherein the remote (HMI) component is configured:

to receive instructions to operate the genset and to deliver the instructions to the genset to operate the genset without the intervention of a motor operator; and to permit selection between the automatic idle mode and the constant idle mode.

2. The system of claim 1 wherein the criteria is an elapsed time.

3. The system of claim 1 wherein the criteria is a distress condition detected by the genset.

4. The system of claim 1 wherein the instructions are received from a well plan stored in a database that is operably coupled to the remote (HMI) component.

5. The system of claim 1 wherein the instructions dictate a selection between the automatic idle mode and the constant idle mode.

6. The system of claim 1 wherein the instructions come from control algorithms from a remote controller.

7. The system of claim 1 wherein a selection between the automatic idle mode and the constant idle mode is received from control algorithms from a remote controller.

8. A method of operating a drilling rig including a genset, the method comprising:

operating the genset to provide power to a drilling operation; and receiving a selection between local mode, remote (HMI) mode, and automatic mode, wherein local mode requires a motor operator to manually start and stop the genset, wherein remote mode enables a driller to operate the genset via a HMI without needing a motor operator, and wherein in an automatic mode the genset is operated according to predetermined instructions.

9. The method of claim 8 wherein the predetermined instructions comprise at least one of a well plan, a rig state, a predictive control, and in-built controller algorithms.

10. The method of claim 9 wherein the well plan includes a power requirement schedule.

11. The method of claim 8 wherein receiving the selection comprises receiving the selection from a well plan stored on a database.

12. The method of claim 8 wherein receiving the selection comprises receiving the selection from one or more control algorithms from a remote controller.

13. The method of claim 8, further comprising informing a motor operator of the selection between modes.

14. The method of claim 8, further comprising receiving a confirmation from a motor operator to confirm the selection between modes.

15. The method of claim 8 wherein operating the genset to provide power to the drilling operation comprises at least one of providing electrical power and mechanical power.

16. The method of claim 8 wherein operating the genset to provide power to the drilling operation comprises powering a top drive of the drilling operation.

17. A system for operating a power system for a drilling operation, the system comprising:

a first terminal at the power system and configured to be operated by a motor operator;

a second terminal at a remote location and configured to be operated by a driller; and a human-machine-interface (HMI) configured to facilitate communication between the first terminal, the second terminal, and the power system, wherein the HMI permits the motor operator and the driller to communicate about operation of the power system, and permits the driller at the second terminal to operate the power system without requiring action from the motor operator at the first terminal, wherein the power system is configured to operate in an automatic idle mode in which the power system will shut off under predefined conditions and a constant idle mode in which the power system will continue to idle until instructed to stop from either the first or second terminal.

18. The system of claim 17 wherein the second terminal is configured to receive inputs to select between automatic idle mode and constant idle mode.

19. The system of claim 17 wherein the HMI is further configured to receive instructions from a remote database or controller that dictate a selection between automatic idle mode and constant idle mode.

20. A system for operating a power system for a drilling operation, the system comprising:

a first terminal at the power system and configured to be operated by a motor operator;

a second terminal at a remote location and configured to be operated by a driller; and a human-machine-interface (HMI) configured to facilitate communication between the first terminal, the second terminal, and the power system, wherein the HMI permits the motor operator and the driller to communicate about operation of the power system, and permits the driller at the second terminal to operate the power system without requiring action from the motor operator at the first terminal, wherein the second terminal is configured to receive a selection between local mode, remote mode, and automatic mode, wherein local mode requires a motor operator to manually start and stop a genset, wherein remote mode enables a driller to operate the genset via a HMI without needing a motor operator, and wherein in an automatic mode the genset is operated according to predetermined instructions.

21. The system of claim 20 wherein the HMI is configured to receive the predetermined instructions in the form of a well plan stored on a database.

22. The system of claim 20 wherein the HMI is configured to receive the predetermined instructions in the form of control algorithms from a remote controller.

* * * * *